United States Patent [19]

Hoots

[11] 4,031,876

[45] June 28, 1977

[54] FUEL ATOMIZER

[76] Inventor: Robert G. Hoots, 7427 Lawrence St., Grand Blanc, Mich. 49505

[22] Filed: July 7, 1975

[21] Appl. No.: 593,718

Related U.S. Application Data

[63] Continuation-in-part of Ser. No. 451,949, March 18, 1974.

[52] U.S. Cl. ..... 123/141; 123/119 E; 123/1 A

[51] Int. Cl.[2] ..... F02M 29/00

[58] Field of Search ..... 123/141, 119 E, 1 A, 123/3; 48/180 R

[56] References Cited

UNITED STATES PATENTS

| | | | |
|---|---|---|---|
| 1,398,899 | 11/1921 | Hughes | 48/180 |
| 1,401,609 | 12/1921 | Klein | 48/180 |
| 2,535,410 | 12/1950 | Grevas | 48/180 |
| 2,789,796 | 4/1957 | Mansfield | 123/119 A X |
| 3,682,608 | 8/1972 | Hicks | 123/119 E X |
| 3,730,160 | 5/1973 | Hughes | 123/141 |

*Primary Examiner*—C. J. Husar
*Assistant Examiner*—Ira S. Lazarus
*Attorney, Agent, or Firm*—Basile, Weintraub and VanOphem

[57] ABSTRACT

Fuel atomizing devices for use with internal combustion engines are mounted between the intake manifold and carburetor. The devices are aluminum plates having a copperbrass grid disposed in a throughbore formed therethrough.

7 Claims, 4 Drawing Figures

FUEL ATOMIZER

CROSS-REFERENCE TO RELATED APPLICATIONS

This application is a continuation-in-part application of co-pending U.S. patent application Ser. No. 451,949, filed Mar. 18, 1974, for "Fuel Atomizer and Recirculation System", the disclosure of which is hereby incorporated by reference.

BACKGROUND OF THE INVENTION

1. Field of the Invention

The present invention pertains to fuel systems. More particularly, the present invention pertains to devices for breaking down liquid fuels into mist-like particles. Even more particularly, the present invention pertains to devices for rendering liquid fuels mist-like and which are particularly adapted for use in internal combustion engines.

2. Prior Art

In the above-referred to copending application there is disclosed a fuel atomizer and recirculation system which is adapted to overcome present gasoline and other vehicle fuel consumption problems. The system of the copending application requires a recirculation of excess fuels to the vapor cannister and therefrom to the carburetor or directly to the carburetor, depending on the degree of emission control equipment on the vehicle. While the device and system of the copending application is extremely efficacious, it would be economically advantageous to eliminate the recirculation system.

Furthermore, it has been found that certain other improvements in the system could be effectuated in order to overcome climatic conditions, such as extreme humidity and cold. Under such conditions it is possible that an engine having the system thereon could stall or not start.

Thus, the present invention is directed to improving the device of the copending application to overcome the deficiencies pointed out herein.

SUMMARY OF THE INVENTION

In accordance with the present invention there is provided a fuel atomizing system for internal combustion engines. The system includes a support member which is mounted between the intake manifold and the carburetor of the engine. The support member has at least two throughbores formed therethrough which are in communication with the carburetor and intake manifold.

A grid comprising a plurality of superposed layers of brass and copper fine mesh screens is disposed in the bores. The grid breaks down the liquid fuel issuing from the carburetor into mist-like particles. The copper layers of the grid have a coating of black oxide and yellow dichromate deposited thereon.

The support member is, preferably, formed from aluminum and includes an internal bore which provides communication between the grid regions of the throughbores to equalize the fuel flow.

For a more complete understanding of the present invention reference is made to the following detailed description and accompanying drawing. In the drawing like reference characters refer to like parts throughout the several views, in which:

DESCRIPTION OF THE PREFERRED EMBODIMENTS

Figure 1:
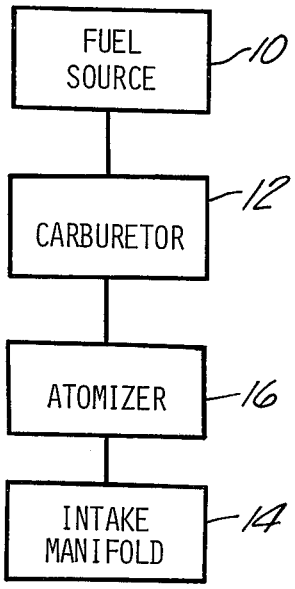
FIG. 1 is a schematic flow sheet depicting the flow of fuel in accordance herewith.

With reference to the drawing, and in particular FIG. 1, there is depicted a conventional fuel system attendant a modern day internal combustion engine, as found in automobiles. Such systems, as shown in FIG. 1, include a fuel source 10 connected to a carburetor 12 which normally opens directly into an intake manifold 14. In accordance with the present invention interposed between the carburetor and intake manifold is the atomizer 16 of the present invention.

At the outset it is to be noted that the term "internal combustion engine", as used herein and in the appended claims, is meant to include diesel engines, aircraft engines, as well as both four-stroke and two-stroke gasoline engines. However, for purposes of facility of understanding the present invention will be detailed with reference to a stroking engine.

Furthermore, as used herein the terms "vapor" and "mist" are synonymous, and is meant to define fine particles or droplets of liquid fuel as issued from the grid deployed in the practice of the present invention.

Figure 2:
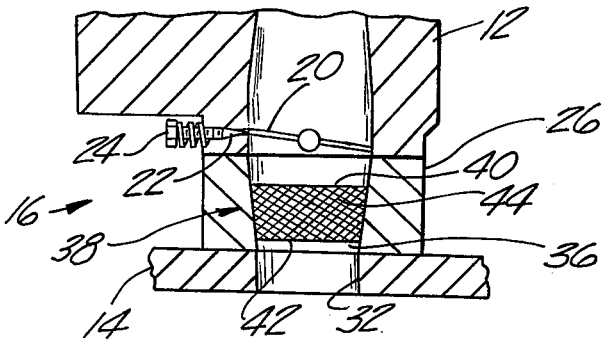
FIG. 2 is a partial cross-sectional view depicting a carburetor and an intake manifold with the device of the present invention disposed therebetween.
Figure 3:
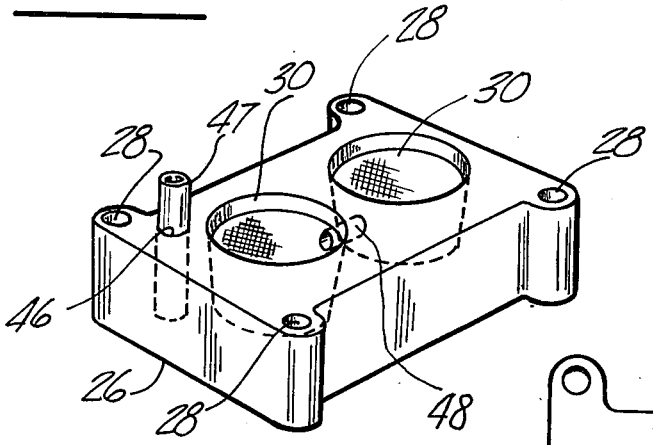
FIG. 3 is a perspective view, partly in phantom depicting the atomizer of the present invention associated with a two barrel carburetor.

Referring again to the drawing, and in particular FIGS. 2 and 3, there is shown in further detail the construction and deployment of the present invention. The carburetor 12 is of conventional construction and includes a throttle control butterfly valve 20 and a needle point valve 22 which is threadably adjustable via adjusting screw 24 in a manner well-known to the skilled artisan.

The device 16 hereof is mounted between the carburetor 12 and the intake manifold 14. The device 16 generally comprises a support or base member 26. The base member 26 is configured such that it fits, with facility, between the carburetor and intake manifold. Thus, a rectangular configuration is preferred.

Because the efficiency of the misting of fuel has been found to be temperature dependent, it is necessary that the base member 26 not retain heat. Thus, because of its low thermal conductivity, it is preferred that the base member 26 be formed from aluminum.

The base member 26 is provided with a plurality of lug-receiving bores 28 through which the device 16 is secured to the intake manifold 14. Suitable lugs (not shown) are inserted through the bores 28 and threadably secured to the intake manifold in suitable threaded apertures (not shown).

Depending on the number of barrels associated with the carburetor, the base member 26 is provided with a throughbore 30 for each of such barrels. In other words, for each barrel of the carburetor there is provided a throughbore 30 in the base member 26. Thus, as depicted in FIGS. 2 and 3, the present invention is shown as applicable to a two-barrel carburetor.

Each throughbore 30 is aligned in such manner that they communicate with the carburetor 12 and the intake port 32 of the manifold 14, as shown. Thus, liquid fuel, such as gasoline, issuing from the carburetor must first pass through the throughbore 30 prior to entering the port 32.

It should be noted that with respect to the bore 30 it is preferred that the bore have a frusto-conical conical configuration. In such an arrangement, the larger diameter 34 faces the carburetor 12, whereas the smaller diameter 36 of the bore 30 faces the inlet port 32. Thus, in accordance with Bernoulli's principle, the velocity of the fuel issuing into the port is greater than the velocity of the fuel entering the throughbore.

A grid, generally indicated at 38, is disposed in the bore 30. The grid 38 may include a top retaining ring 40 and a bottom retaining ring 42 to secure the grid in the bore. Where used, the retaining rings 40, 42 are formed from a heavy bronze.

The grid 38 comprises a plurality of fine mesh grids 44. The fine mesh grids 44 comprise alternating layers of brass and copper grids. The copper grid, having a high thermal conductivity, aids in eliminating any water vapor buildup in the bore. Furthermore, and in accordance herewith, the brass and copper grids are each coated first with potassium dichromate, commonly known as yellow dichromate and then with copper oxide, more commonly known as black oxide prior to installing the grid 38 in the throughbore. The black oxide coating heats the grid to facilitate the misting thereof and to promote the evaporation of any water vapor. The dichromate inhibits the collection of condensation on the grids. It has been found that by so-coating the grids the problems associated with climatic conditions alluded to hereinbefore are greatly reduced. Generally from about 15 to 25 grids are employed to form the grid region or grid 38. However, as pointed out subsequently, the number of grids is a pre-determined function of engine size and carburetor size. The grids are optimally 400 mesh grids (20 holes/inch) which will effectuate a break down of the liquid fuel particles of about 1:2000. In other words, the mesh grids will break each liquid fuel droplet into about 2,000 finer droplets to thereby effectively atomize or vaporize the liquid fuel.

As shown in the drawing the grid 38 is disposed within the bore 30 in the region thereof nearer the intake port 32.

It is to be appeciated that by the practice of the present invention liquid fuels are converted to fine mists prior to introduction of the fuel into the intake port. The use of a mist in lieu of a liquid fuel results in a more efficient and complete combustion of the fuel.

Referring again to the drawing, and in particular, FIG. 3, to create a vacuum across the throughbore 30, a bore 46 is formed co-axially with the bore 30 formed in the device 16. The co-axial bore 46 communicates, at one end thereof, with a bore (not shown) formed in the intake manifold. A hose 47 extends from the other end of the bore 46 to either the vapor cannister of an engine equipped with such pollution control means or to the carburetor. Because of the difference in pressure between the carburetor or cannister and the intake manifold, a suction is created therebetween which causes a faster flow of mist to issue from the bottom of the grid into the intake port 32.

In order to equalize fuel flow through the grids, means, such as an internal transverse bore 48 is formed in the base support member 26. The bore 48 extends between the throughbores 30 and provides communication therebetween. The bore 48 is formed in the region of the grids 38. In this manner, the fuel flow is equalized by the flow of fuel through the bore 48 from one grid to the other, depending on the pressures across the grids.

In a practical embodiment of the present invention a support member 26 of three-fourth inch thickness is provided with a frusto-conical throughbore 30 having a top diameter of one and three-fourth inches and a bottom diameter of one and one-fourth inches. A grid 38, seven-sixteenth inch in length, is disposed in the bore 30 with the bottom retaining ring 42 mounted about one-sixteenth of an inch from the bottom of the device 16. The grid, per se, is comprised of about 15 to 25 fine brass mesh grids each having about 20 holes per inch, and which are coated in the manner heretofore described.

Because of the more complete and efficient combustion of the liquid fuel by the atomization thereof, in order to avoid "flooding" of the carburetor, it is necessary to reduce the force exerted by the fuel pump. In the practice of the present invention, the fuel pump should have an output of about two to three psi as opposed to the ordinary eight psi output. This again results in a lower fuel consumption. This is achieved by disposing a regulator in the fuel line between the carburetor and fuel pump.

Figure 4:
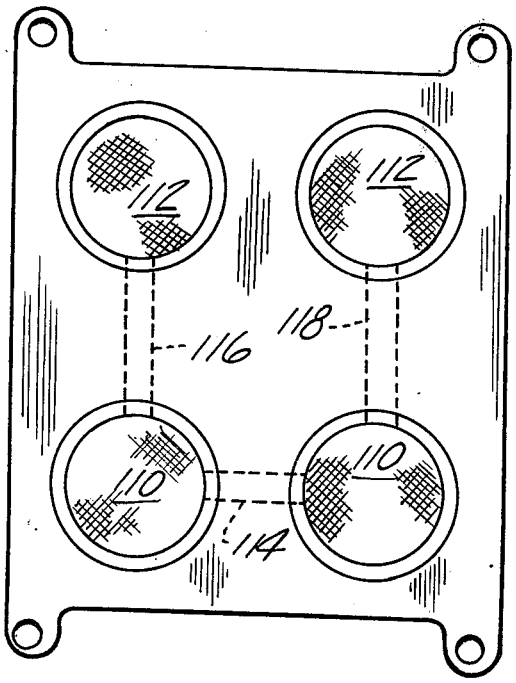
FIG. 4 is a top plan view, partly in phantom, depicting the atomizer of the present invention associated with a four barrel carburetor.

Referring now to FIG. 4, there is depicted therein a form of the present invention for use with a four-barrel carburetor.

According to this form of the invention, there is provided main bores 110 and auxiliary bores 112. The auxiliary bores have a smaller diameter than the main bores and, thus, correspond to the smaller diameters of the auxiliary barrels of a four barrel carburetor. In all other respects the construction of the base support, the grids and the bores, is the same as hereinbefore described. However, in order to equalize the fuel flow across the grids there is provided a first internal bore 114, which is analogous to the bores 48 hereinbefore described.

Extending between one of the auxiliary bores 112, and one of the main bores 110, is an internal bore 116. This bore functions the same as the bore 114 and serves to equalize the fuel flow between the main bore and the auxiliary bore associated therewith. A similar internal bore 118 extends between the other main bore and auxiliary bore. Thus, the four barrel form of the invention, also, equalizes the fuel when all four barrels of the carburetor are operative or when only two of the barrels are operative.

It should be noted that the present invention, when deployed in a modern day vehicle equipped with the necessary anti-pollution devices was capable of surpassing both the 1974 and 1975 erosion standards dictated by the Environmental Protection Agency.

Furthermore, in constructing the present device the size and disposition of the grid network may vary from any one make of automobile to another. The size and disposition of the grid become a predetermined function of the engine size, the carburetor size and the size of the butterfly valve mounted in the carburetor. However, these adjustments are within the ability of the skilled artisan.

Having thus described my invention, what is claimed is:

1. A liquid fuel atomizer device for an internal combustion engine, comprising:

a. a base member having at least two throughbores formed therethrough and at least one internal transverse bore extending between the throughbores and in communication therewith, b. and grids disposed in each of the throughbores comprising a plurality of superposed fine mesh grids comprising alternating layers of copper grids and brass grids, the grids being coated with copper oxide and potassium dichromate, and wherein the transverse bore is in communication with the throughbores in the region of the grids.

2. The device of claim 1 wherein the throughbore has a frusto-conical configuration.

3. The device of claim 1 wherein the base member has a vacuum creating bore formed therein and which has a central axis that is parallel with a central axis of each of the throughbores.

4. The device of claim 1 wherein the base support member is an aluminum base support member.

5. In an internal combustion engine of the type having a carburetor communicating with the intake port of an intake manifold, a liquid fuel atomizer device therefor, comprising:

a. a base member disposed between the carburetor and the intake manifold, the base member having at least two throughbores formed therethrough, the throughbores being in registry with the carburetor and the intake port of the manifold, the base member having an internal transverse bore extending between the throughbores and in communication therewith;

b. a grid disposed in each throughbore and comprising a plurality of superposed alternating layers of copper fine mesh grids and brass fine mesh grids, the grids being coated with copper oxide and potassium dichromate, and wherein the internal transverse bore communicates with the throughbores at the grids disposed in each of the throughbores.

6. The device of claim 5 wherein the base support member is an aluminum base support member.

7. The device of claim 5 wherein the throughbores have a frusto-conical configuration with the larger diameter facing the carburetor and the smaller diameter facing the intake manifold.

* * * * *